US007722553B2

(12) United States Patent
Lev et al.

(10) Patent No.: US 7,722,553 B2
(45) Date of Patent: May 25, 2010

(54) MASSAGE APPARATUS

(75) Inventors: Mordechai Lev, West Bloomfield, MI (US); Roman S. Ferber, West Bloomfield, MI (US); Stephen Chung, Taipei (TW)

(73) Assignee: FKA Distributing Co., Commerce Township, MI (US)

( * ) Notice: Subject to any disclaimer, the term of this patent is extended or adjusted under 35 U.S.C. 154(b) by 1 day.

(21) Appl. No.: 11/972,071

(22) Filed: Jan. 10, 2008

(65) Prior Publication Data

US 2008/0108919 A1 May 8, 2008

Related U.S. Application Data

(63) Continuation of application No. 11/085,408, filed on Mar. 21, 2005, now Pat. No. 7,322,946.

(60) Provisional application No. 60/554,613, filed on Mar. 19, 2004.

(51) Int. Cl.
*A61H 1/00* (2006.01)

(52) U.S. Cl. ..... 601/15; 601/87; 601/112; 601/113

(58) Field of Classification Search ..... 602/15, 602/22, 158, 166, 87, 112, 113; 4/622; 607/86
See application file for complete search history.

(56) References Cited

U.S. PATENT DOCUMENTS 3,841,321 A * 10/1974 Albach et al. ..... 601/72
4,936,294 A 6/1990 Chu
5,305,738 A 4/1994 Shimizu
5,336,159 A 8/1994 Cheng
5,382,221 A 1/1995 Hsu et al.
5,486,156 A 1/1996 Takach
5,685,827 A 11/1997 Shimizu
5,797,859 A 8/1998 Prehodka
5,868,688 A 2/1999 Avidor et al.
6,083,180 A 7/2000 Shimizu
6,149,611 A 11/2000 Chen
6,217,533 B1 4/2001 McCambridge
6,454,732 B1 9/2002 Lee
6,511,446 B1 1/2003 Wu
D473,316 S 4/2003 Chou
D476,086 S 6/2003 Christianson et al.
D478,670 S 8/2003 Tsai
6,602,212 B1 8/2003 Ahn
6,698,038 B2 * 3/2004 Bastia et al. ..... 4/622
6,811,539 B1 11/2004 Nguyen
6,866,776 B2 3/2005 Leason et al.
6,911,010 B2 6/2005 Dirks et al.
2003/0028134 A1 2/2003 Lev et al.
2005/0187496 A1 * 8/2005 Ho ..... 601/15
2006/0036198 A1 * 2/2006 Cafaro et al. ..... 601/16
2006/0235494 A1 10/2006 Vanderschuit
2007/0050906 A1 * 3/2007 Cohen et al. ..... 4/622

* cited by examiner

*Primary Examiner*—Michael A. Brown
(74) *Attorney, Agent, or Firm*—Brooks Kushman P.C.

(57) ABSTRACT

A massage apparatus is provided which includes a housing, a motor disposed within the housing, and at least one massage center provided on the housing. The massage center includes an outer massage member and an inner massage member, where the outer massage member at least partially circumferentially surrounds the inner massage member. The outer and inner massage members are operably connected to the motor for providing rotation of the massage members.

28 Claims, 5 Drawing Sheets

MASSAGE APPARATUS

CROSS-REFERENCE TO RELATED APPLICATIONS

This application is a continuation of U.S. Ser. No. 11/085,408 filed Mar. 21, 2005 and issued on Jan. 29, 2008 as U.S. Pat. No. 7,322,946 B2, which claims the benefit of U.S. provisional application Ser. No. 60/554,613 filed Mar. 19, 2004, which are incorporated in their entirety by reference herein.

BACKGROUND OF THE INVENTION

1. Field of the Invention

This invention relates to a massage apparatus for massaging the feet and other parts of the body.

2. Background Art

Most people experience foot problems at some time in their lives. This is not surprising, considering that many people are employed in jobs that require them to be on their feet all day. In fact, even an average day of walking can exert force equal to several hundred tons of pressure on the feet.

Power operated foot massagers are often used to treat muscle tension and fatigue, where massage increasing circulation as well as relaxing and massaging the muscles. Conventionally, foot massaging devices for home use have included kneading ball-type massagers, roller type massagers, and vibrating massagers. However, a need exists for a foot massager which offers finer control of massage features, as well as provides the ability to provide heat and massage simultaneously to the feet specifically at those areas targeted by a user.

SUMMARY OF THE INVENTION

Accordingly, a massage apparatus is provided which includes a housing, a motor disposed within the housing, and at least one massage center provided on the housing. The massage center includes an outer massage member and an inner massage member, where the outer massage member at least partially circumferentially surrounds the inner massage member. The outer and inner massage members are operably connected to the motor for providing rotation of the massage members.

The outer massage member and the inner massage member can have a concentric configuration, where the inner massage member can be generally circular and the outer massage member can be generally annular. Each of the massage members can include a base and a cover, and massage balls can be housed between each massage member base and corresponding massage member cover, and protrude at least partially through apertures provided in each cover. According to one aspect of the present invention, the cover of one of the inner massage member and the outer massage member, or both, can be generally translucent.

The inner and outer massage members can rotate in different directions. According to one aspect of the present invention, the motor imparts rotary motion to the inner and outer massage members via a gear train, the gear train having at least one gear shaft extending through an aperture in the housing and arranged to receive the inner massage member. A first gear can be provided on the inner massage member which cooperates with a second gear provided on the outer massage member, such that rotation of the gear shaft causes rotation of the inner massage member in a first direction which in turn drives the outer massage member in a second direction opposite the first direction. According to one aspect of the present invention, the first and second gears cooperate via counterclockwise gears disposed therebetween and mounted to the housing.

A heating assembly can be disposed within the massage center for providing heat to the user's foot when the foot is placed on the massage center. According to one aspect of the present invention, the heating assembly can include a printed circuit board mounted within the outer massage member, the printed circuit board having infrared lamps provided thereon.

An upper surface of the housing can include a plurality of raised ribs, and the housing can also include a switch for providing power to the motor. The switch could be a multi-function switch that provides a different mode of operation of the massage center with every press. Still further, an indicator light can be provided to indicate a mode of operation of the massage apparatus.

According to one aspect of the present invention, the housing can include a bath chamber having a bottom surface and a wall structure extending upwardly therefrom, where the massage center is disposed on the bath chamber bottom surface. According to another aspect of the present invention, a cover constructed of a cushioning material can be provided which is arranged to cover the housing.

In further accordance with the present invention, a massage apparatus is provided which includes a housing, a motor disposed within the housing, and two spaced massage centers provided on the housing. Each massage center includes a generally circular inner massage member and a generally annular outer massage member disposed in a concentric configuration, where the outer and inner massage members are operably connected to the motor for providing rotation of the inner massage member in a first direction and rotation of the outer massage member in a second direction opposite the first direction.

Still further, according to another aspect of the present invention, a foot massager is provided which includes a housing, a motor disposed within the housing, and at least one massage center provided on the housing and including an outer massage member and an inner massage member. The outer massage member at least partially circumferentially surrounds the inner massage member, where the outer and inner massage members are operably connected to the motor for providing rotation of the massage members. A heating assembly is disposed within the massage center for providing heat to a user's foot when the foot is placed on the massage center.

The above features and advantages, along with other features and advantages of the present invention are readily apparent from the following detailed description of the invention when taken in connection with the accompanying drawings.

DETAILED DESCRIPTION OF THE PREFERRED EMBODIMENT(S)

Figure 1:
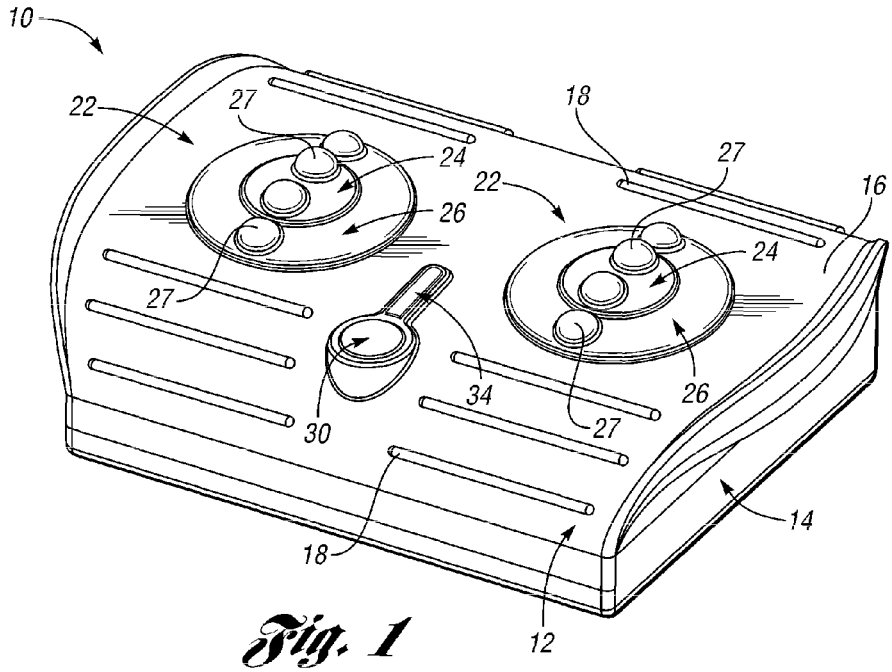
FIG. 1 is a perspective view of a massage apparatus according to the present invention.
Figure 2:
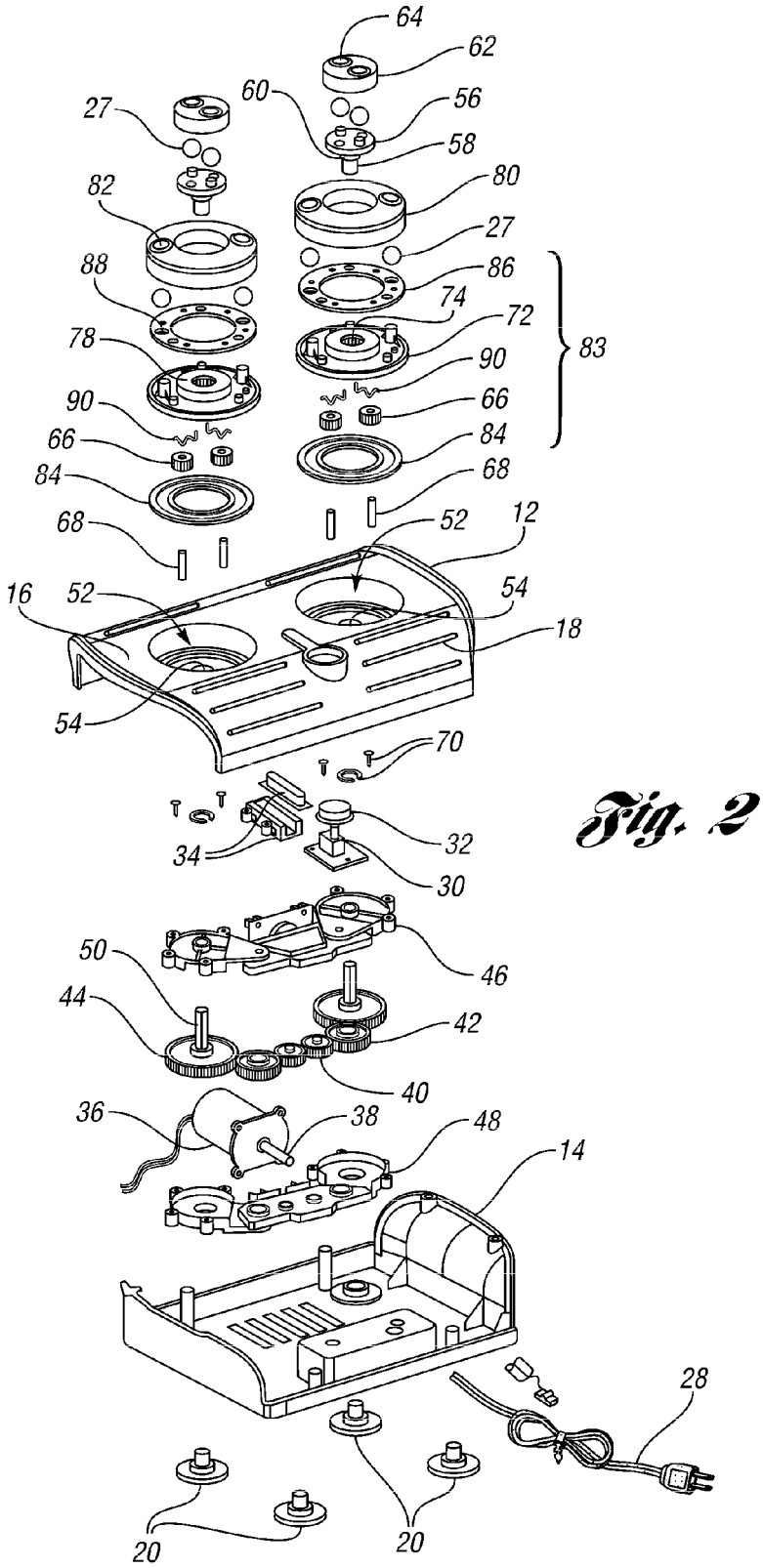
FIG. 2 is an exploded view of the massage apparatus of FIG. 1.

Referring first to FIGS. 1-2, a massage apparatus constructed according to the present invention is depicted and designated generally by reference numeral 10. Massage apparatus 10 can be used to provide massage and heat to body parts, such as the feet. Massage apparatus 10 is preferably constructed from a plastic material so as to be lightweight, portable, durable, and capable of supporting a user's feet thereon. Massage apparatus 10 advantageously provides deep kneading action to a user's feet via counter-rotating massage members as described below.

As shown in FIGS. 1-2, massage apparatus 10 includes a housing configured to be placed on a generally planar support surface, such as a floor or the like, and which is preferably constructed from two pieces, a top housing 12 and a bottom housing 14. Top housing 12 includes an upper surface 16 which can be generally parallel to the support surface on which massage apparatus 10 is placed, or alternatively, can be slanted downward toward the user. As shown, upper surface 16 preferably includes a plurality of raised ribs 18 which can massage a user's feet upon contact. Of course, other shapes, sizes, and configurations of ribs 18 are fully contemplated according to the present invention. As best shown in FIG. 2, bottom housing 14 is preferably provided with feet 20 attached thereto, wherein feet 20 are preferably constructed from a material such as rubber to prevent movement of massage apparatus 10 along the support surface. Massage apparatus 10 is of a length and width to accommodate the feet of an adult user and allow for targeted therapy as described below.

With reference to FIG. 1, upper surface 16 includes one or more massage centers 22 which allow for massage and heat to be targeted to specific locations of the foot such as the ball, heel, or arch. According to one aspect of the present invention, two spaced massage centers 22 are provided, one for each foot. Massage centers 22 each include at least two rotatable massage members 24, 26, wherein rotation of the massage members 24, 26 is motorized as described below. Advantageously, massage centers 22 are configured such that an outer massage member 26 at least partially circumferentially surrounds an inner massage member 24. Preferably, outer massage member 26 and inner massage member 24 are concentric, but could alternatively have an eccentric configuration. The arrangement of massage members 24, 26 according to the present invention allows massage members to be rotating in different directions as further described below to provide a more unique massage experience. While two spaced massage centers 22 are shown and described herein, it is understood that any number and placement of massage centers 22 on upper surface 16 is contemplated in accordance with the present invention.

Massage members 24, 26 depicted herein each include massage balls 27 (FIGS. 1 and 2) which provide pressure points to gently massage a user's foot when contacted. Rotation of massage members 24, 26 in contact with a user's foot helps relieve tightness and tiredness along the feet, as well as for reflexology purposes. The applied pressure of the foot on massage members 24, 26 can be adjusted by the user for optimum comfort. It is understood that the particular massage members 24, 26 shown and described herein are merely exemplary, and that any other suitable massage members can be used in accordance with the present invention.

Massage apparatus 10 receives power through an electrical cord 28 (FIG. 2), which is configured to plug into a standard electrical outlet. Alternatively, massage apparatus 10 could be battery-operated. Because massage apparatus 10 may include devices and electrical circuits that require a voltage other than that provided by a standard electrical outlet, a transformer (not shown) can be provided. Referring again to FIGS. 1-2, a switch 30 is accessible via upper surface 16 of top housing 12, where switch 30 can be depressed by a user to selectively provide power to a motor 36 for the rotation of massage members 24, 26, and additionally for providing power to a heating assembly 83 to provide heat to a user's feet as described below. Switch includes a flexible, preferably rubber, cover 32 (FIG. 2) which is flexible enough to allow for depression using a user's foot or toe. As shown, switch 30 is preferably ergonomically located in a central region of upper surface 16 close to the user.

According to one aspect of the present invention, switch 30 is a multi-position push switch which is in communication with motor 36 and heating assembly 83. For example, switch 30 can be depressed once to cause rotation of massage members 24, 26, depressed a second time to activate heating assembly 83 in addition to massage members 24, 26, and depressed a third time to turn off massage apparatus 10. Correspondingly, an indicator light 34, such as an LED, can also be provided on upper surface 16 in communication with switch 30 to inform the user as to the mode in which massage apparatus 10 is currently operating. Specifically, indicator light 34 is preferably illuminated in a first color, such as blue, when switch 30 is depressed once and massage members 24, 26 are activated, and then illuminated in a second color, such as red, when switch 30 is depressed a second time and heating assembly 83 is additionally activated.

In addition to the modes described above, switch 30 could have even more positions to allow for multiple modes of activation of massage apparatus 10, such as different rotation speeds or directions of massage members 24, 26 with every press. In an alternative embodiment, separate push-push (push ON, push OFF) switches could be provided for separately activating the massage and heat functions of massage apparatus 10. Additionally, it is contemplated that switch 30 could be replaced by a rotatable selector knob.

Although the activation of motor 36 is preferably provided upon depression of a push-type switch 30 as described above, the motorized rotation of massage members 24, 26 could alternatively be activated by pressure of a user's foot applied thereon, which then would establish electrical contact to supply power to motor 36. In this case, the operation of motor 36 would not governed by switch 30, but rather power would be supplied to motor 36 as long as massage apparatus 10 was plugged in.

Figure 3:
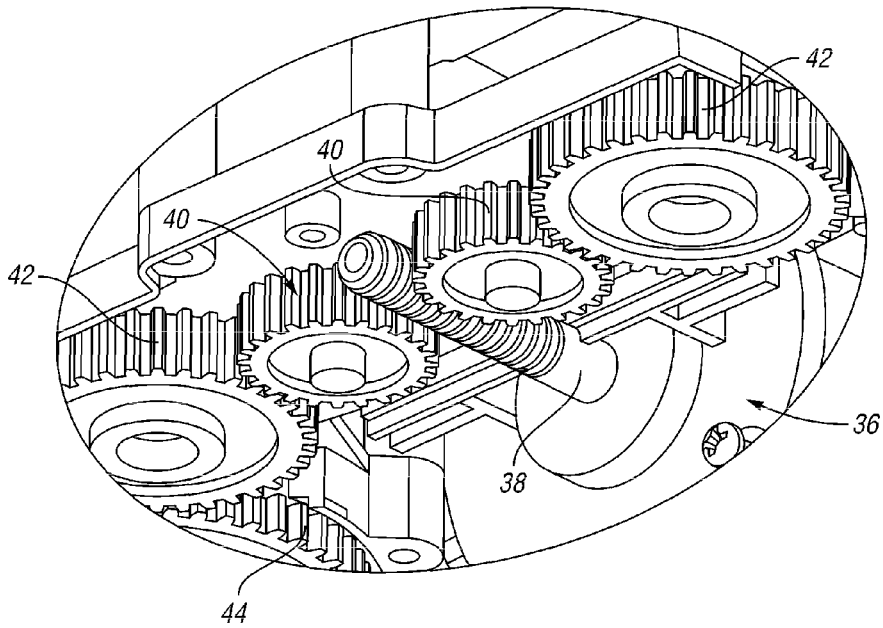
FIG. 3 is a fragmentary view of the motor shaft and gear assembly.
Figure 4:
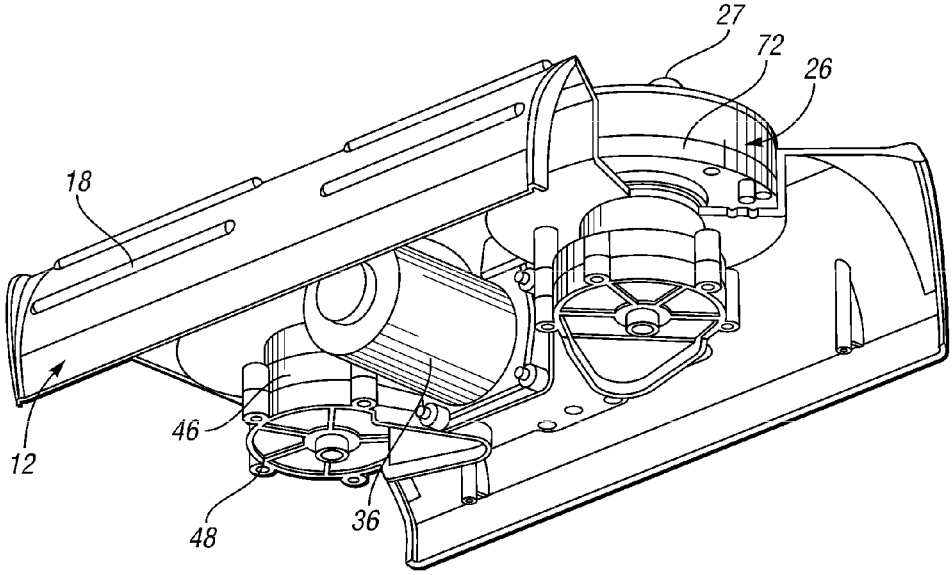
FIG. 4 is a bottom perspective view of the motor and gear box mounted to the top housing, wherein the bottom housing is removed and a partial view of one recess is shown.
Figure 5:
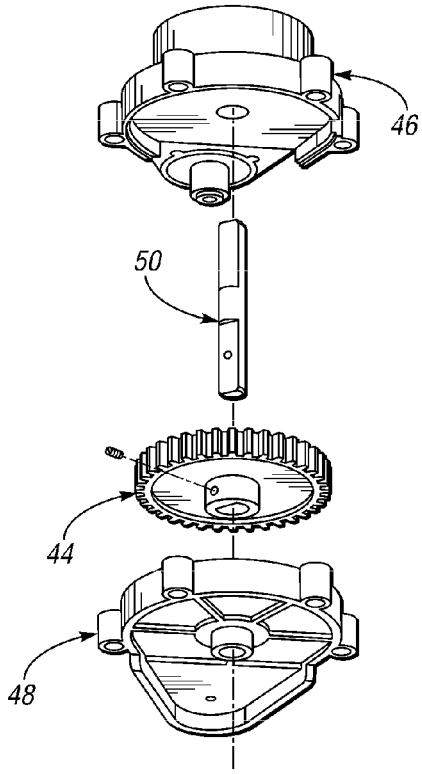
FIG. 5 is a fragmentary, exploded view of the outer gear and gear box assembly.

For the operation of massage centers 22, a motor 36 is mounted on an underside of top housing 12 as shown in FIGS. 2-4. Motor 36 imparts rotary motion via a multi-stage gear train to massage members 24, 26. Specifically, motor 36 includes a threaded output shaft 38 that is rotatably driven by motor 36 and engages inner gears 40 on either side thereof Inner gears 40, in turn, engage intermediate gears 42, which in turn engage outer gears 44. As shown in FIGS. 2 and 4, the gear train is disposed within a gear box which is typically of two-piece construction and includes an upper gear box 46 and a lower gear box 48. Each outer gear 44 includes a gear shaft 50 protruding upwardly therefrom as shown in FIGS. 2 and 5, where gear shafts 50 extend through upper gear box 48. Top housing 12 includes recesses 52 provided therein which include apertures 54 sized to allow gear shafts 50 to extend therethrough. Although a specific gear train configuration is shown and described herein, it is understood that other gear assemblies could be used to affect rotation of the massage members 24, 26 in accordance with the present invention.

Referring again to FIG. 2, gear shafts 50 extend through various components of heating assembly 83 and outer massage member 26 as described below to receive inner massage member 24 thereon. Specifically, inner massage member 24 includes a base 56 having a downwardly extending shaft 58, where shaft 58 includes a gear 60 provided thereon. A cover 62 is fitted over base 56 to form the assembled inner massage member 24, where massage balls 27 are received in apertures 64 provided in cover 62 to as to extend above cover 62 but still be movable with respect thereto for massaging a user's feet upon contact.

Figure 6:
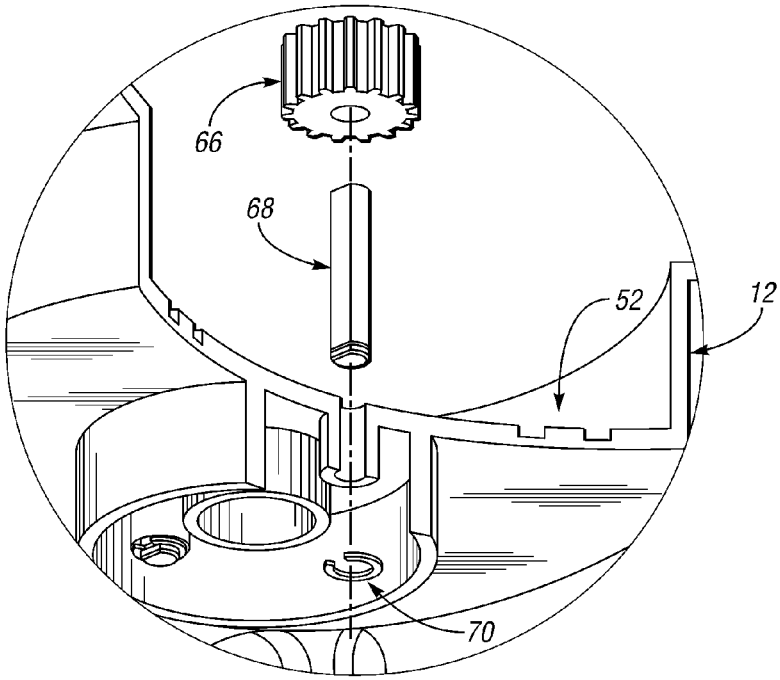
FIG. 6 is a fragmentary, exploded view of the assembly of the counterclockwise rotation gear to the top housing.
Figure 7:
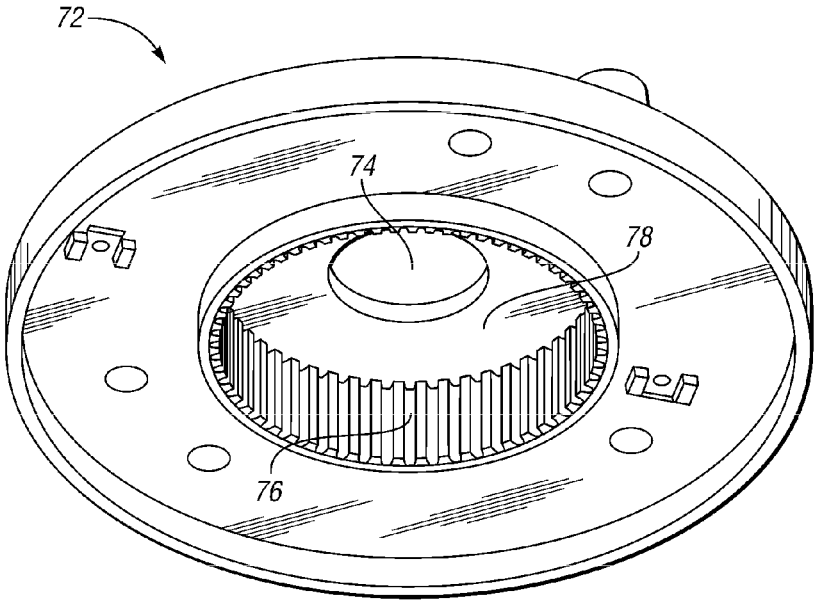
FIG. 7 is a bottom perspective view of the outer massage member base.

With reference to FIGS. 2 and 6-7, two counterclockwise gears 66 and corresponding gear shafts 68 are mounted within recesses 52 and are constrained from axial movement by retaining clips 70. Outer massage member 26 includes a substrate, such a base 72 having an aperture 74 through which gear shaft 50 extends. As best shown in FIG. 7, base 72 includes a ring gear 76 provided in a hub 78 thereof. Counterclockwise gears 66 engage ring gear 76 as well as gear 60 provided on shaft 58 of inner massage member base 56. As such, rotation of gear shaft 50 causes rotation of inner massage member 24 in one direction, where gear 60 cooperates with counterclockwise gears 66 to drive outer massage member base 72 in the opposite direction about an axis. As with inner massage member 24, an annular cover 80 is fitted over base 72 to form the assembled outer massage member 26, where massage balls 27 are received in apertures 82 provided in cover 80. Cover 80 is preferably translucent so as to allow for the function of heating assembly 83 as described below.

For inner and outer massage members 24, 26, any number of massage balls 27 could be utilized. Massage nodes could alternatively be integrally formed in covers 62, 80, and the respective covers 62, 80 and bases 56, 72 could instead be of one piece construction. Preferably, inner massage member 24 is affixed to gear shaft 50, thereby preventing the removal of outer massage member 26 as well, such that massage members 24, 26 will continue to rotate even when in contact with a user's foot. Of course, it is fully contemplated that inner and outer massage members 24, 26 could instead be removable and interchangeable by a user as described in U.S. Pat. No. 6,568,000 which is incorporated by reference herein.

As shown in the exploded view of FIG. 2, massage apparatus 10 includes a heating assembly 83 within massage centers 22 for providing heat to the foot surface when the foot is placed on massage centers 22. According to a preferred embodiment of the present invention, heating assembly 83 uses infrared rays. Infrared rays allow heat to penetrate deep underneath the surface of the skin, causing the pores of the skin to be opened and promoting metabolism and excretion of the body through increased blood circulation. Heating assembly 83 includes a conductive contact, such as an annular conducting plate 84 disposed in each recess 52 and in electrical communication with switch 30. An annular printed circuit board 86 is mounted between outer massage member base 72 and cover 80, where printed circuit board 86 includes infrared lamps 88 provided thereon. Printed circuit boards 86 are in electrical communication with each conducting plate 84 via a conductor 90, such as a brush, so that electrical communication is maintained while printed circuit board 86 rotates with outer massage member base 72. Upon activation of the massage and heating mode via depression of switch 30, power is supplied to printed circuit board 86 and infrared lamps 88, providing infrared heat to a user's foot via outer massage member 26. Of course, it is understood that inner massage member 24 could include infrared lamps 88 in addition to or as an alternative to outer massage member 26.

While the components of massage members 24, 26 and heating assembly 83 have been separately described above, reference should be made to the exploded view of FIG. 2 for the order of assembly of the components on gear shafts 50 and within recesses 52. It is also understood that various changes to the specific configuration of heating assembly and massage member components can be made while still maintaining their function as described herein.

Although massage apparatus 10 is illustrated and described herein as being particularly adaptable for use as a foot massager, it is understood that massage apparatus 10 of the present invention may have other embodiments as described below, wherein the components and operation are similar to that previously described except as noted.

Figure 8:
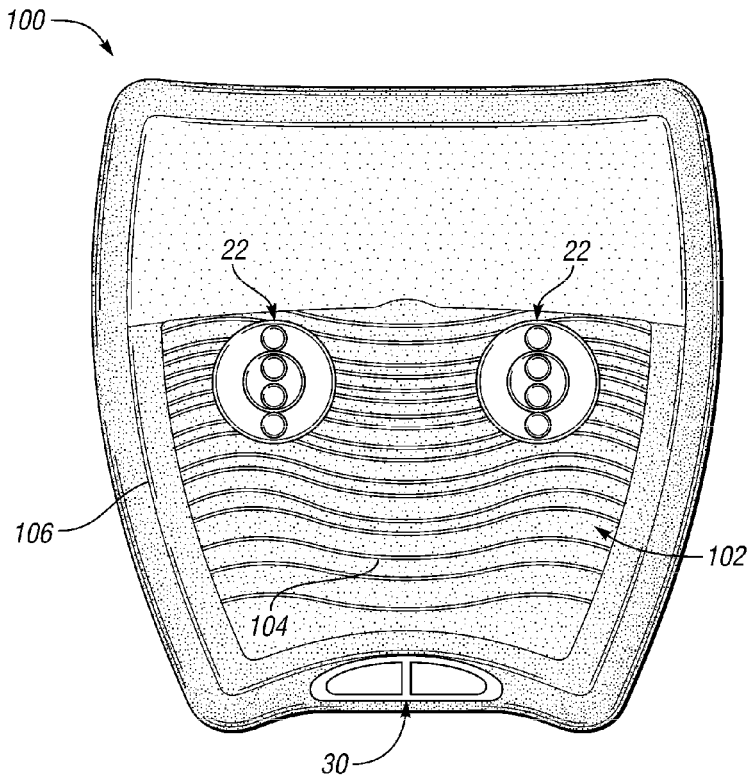
FIG. 8 is a top plan view of an alternative foot bath embodiment according to the present invention.

With reference to FIG. 8, a foot bath embodiment is depicted, wherein foot bath 100 includes a bath chamber 102 for containing fluid, such as water, and receiving a user's feet therein. Bath chamber 102 includes a bottom surface 104 and a wall structure 106 extending upwardly therefrom. Bottom surface 104 includes two spaced massage centers 22 as described above. Advantageously, placement of a user's feet on massage centers 22 allows for both feet to receive targeted therapy simultaneously while the feet are still submersed in the water filling bath chamber 102. Although not shown, gear shafts 50 extend through apertures provided in bottom surface to mate with massage members 24, 26, and seals (not shown) sized to be received on gear shafts 50 are provided to protect against leakage of fluid beneath bath chamber bottom surface 104. At least one switch 30 is provided on wall structure 106 to operate massage centers 22 in the manner described above. While two spaced massage centers 22 are depicted, it is understood that any number and placement of massage centers 22 within bottom surface 104 is contemplated.

Figure 9:
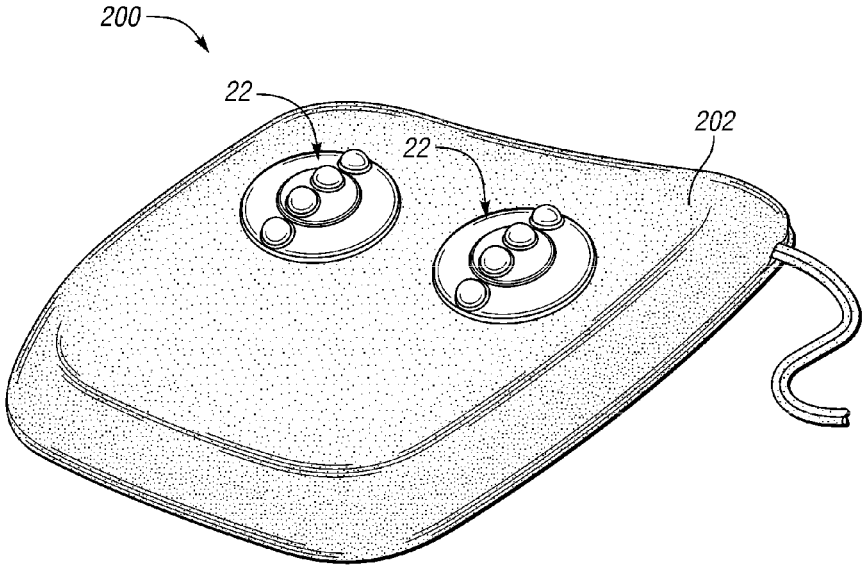
FIG. 9 is a perspective view of an alternative cushion embodiment according to the present invention.

Referring now to FIG. 9, an alternative massage cushion embodiment is illustrated. Massage cushion 200 is sized to be affixable to a chair or the like, and includes a cover 202 made from a cushioning material which covers an internal housing (not shown) to provide comfortable support to a user. Massage centers 22 can protrude from cover 202 as shown at a location optimized for providing the massage effect to a portion of the back of a user when sitting in the chair. Alternatively, massage centers 22 could be located underneath cover 202 and their massaging effect felt through cover 202. Massage cushion 200 can further include a strap or plurality of straps (not shown) for securing massage cushion 200 to an upright back support of the chair. Switches (not shown) for operating the massage and heat functions can be mounted to one of the sides massage cushion 200 or can be included in a hand-held remote (not shown) in communication with massage cushion 200 for ease in operation while sitting in the chair.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat therapy apparatus comprising:

a housing;

a substrate mounted to the housing for rotation relative thereto;

a heater mounted to the substrate for providing a heat therapy effect from the substrate;

a pair of conductive contacts each mounted to one of the substrate and the housing; and a pair of conductive brushes each mounted to the other of the substrate and the housing in engagement with one of the contacts for maintaining engagement during rotation of the substrate relative to the housing;

wherein at least two of the contacts and brushes are in electrical communication with the heater and rotate relative to the housing with rotation of the substrate and the heater for conducting electricity to the heater.

2. The heat therapy apparatus of claim 1 further comprising a motor oriented in the housing and operably connected to the substrate for driving the substrate for rotation relative to the housing.

3. The heat therapy apparatus of claim 1 wherein the heater further comprises at least one infrared lamp.

4. The heat therapy apparatus of claim 1 further comprising a circuit board mounted to the substrate, wherein the heater is connected to the circuit board, and two of the contacts and brushes are in electrical communication with the circuit board for conducting electricity from the housing to the circuit board.

5. The heat therapy apparatus of claim 1 wherein the pair of conductive contacts are each mounted to the housing, and the pair of conductive brushes are each mounted to the substrate in electrical communication with the heater for conducting electricity from the contacts to the heater.

6. The heat therapy apparatus of claim 5 wherein the contacts are generally annular.

7. The heat therapy apparatus of claim 1 further comprising a massage formation provided on the substrate for providing a massage effect.

8. The heat therapy apparatus of claim 7 wherein the heater further comprises at least one infrared lamp disposed beneath the massage formation.

9. The heat therapy apparatus of claim 7 wherein the heater further comprises at least one infrared lamp disposed within the massage formation.

10. The heat therapy apparatus of claim 7 wherein the substrate rotates about an axis and the massage formation is offset from the axis.

11. The heat therapy apparatus of claim 1 farther comprising:

a motor disposed in the housing; and at least one massage center provided on the housing and including an outer massage member and an inner massage member, the outer massage member at least partially surrounding the inner massage member in a concentric configuration, wherein the outer and inner massage members are operably connected to the motor for providing rotation of the massage members, the inner and outer massage members capable of rotating separately.

12. The heat therapy apparatus of claim 11 wherein one of the outer massage member and the inner massage member is mounted to the substrate.

13. The heat therapy apparatus of claim 11 wherein the outer massage member and the inner massage member rotate in different directions.

14. The heat therapy apparatus of claim 11 wherein each of the massage members includes a base and a cover, and massage balls are housed between each massage member base and corresponding massage member cover, and protrude at least partially through apertures provided in each cover.

15. The heat therapy apparatus of claim 14 wherein the cover of at least one of the inner massage member and the outer massage member is generally translucent.

16. The heat therapy apparatus of claim 11 wherein the housing includes a bath chamber having a bottom surface and a wall structure extending upwardly therefrom, wherein the at least one massage center is disposed on the bath chamber bottom surface.

17. The heat therapy apparatus of claim 11 further comprising a cover constructed of a cushioning material which is arranged to cover the housing.

18. The heat therapy apparatus of claim 1 further comprising:

a motor disposed within the housing; and two spaced massage centers provided on the housing, each massage center including a generally circular inner massage member and a generally annular outer massage member disposed in a concentric configuration, wherein the outer and inner massage members are operably connected to the motor for providing rotation of the inner massage member in a first direction and rotation of the outer massage member in a second direction opposite the first direction.

19. A heat therapy apparatus comprising:

a housing;

a base mounted to the housing for rotation relative thereto;

a heater mounted to the base for providing a heat therapy effect from the base;

a pair of conductive plates each mounted to one of the base and the housing; and a pair of conductive brushes each mounted to the other of the base and the housing in engagement with one of the contacts for maintaining engagement during rotation of the base relative to the housing;

wherein at least two of the contacts and brushes are in electrical communication with the heater and rotate relative to the housing with rotation of the base and the heater for conducting electricity to the heater.

20. A heat therapy apparatus comprising:

a housing;

a motor oriented in the housing;

a first substrate and a second substrate each mounted to the housing for rotation relative thereto, and operably driven for rotation by the motor;

a first massage formation provided on the first substrate and a second massage formation provided on the second substrate for providing a massage effect;

a first heater mounted to the first substrate and a second heater mounted to the second substrate for providing a heat therapy effect from the substrates;

a first pair of conductive contacts each mounted to one of the first substrate and the housing;

a first pair of conductive brushes each mounted to the other of the first substrate and the housing in engagement with one of the first pair of contacts for maintaining engagement during rotation of the first substrate relative to the housing;

a second pair of conductive contacts each mounted to one of the second substrate and the housing; and a second pair of conductive brushes each mounted to the other of the second substrate and the housing in engagement with one of the second pair of contacts for maintaining engagement during rotation of the second substrate relative to the housing;

wherein at least two of the first pair of contacts and the first pair of brushes are in electrical communication with the first heater and rotate relative to the housing with rotation of the first substrate and the first heater for conducting electricity to the first heater, and at least two of the second pair of contacts and the second pair of brushes are in electrical communication with the second heater and rotate relative to the housing with rotation of the second substrate and the second heater for conducting electricity to the second heater.

21. The heat therapy apparatus of claim 19 further comprising a motor oriented in the housing and operably connected to the base for driving the base for rotation relative to the housing.

22. The heat therapy apparatus of claim 19 wherein the heater further comprises at least one infrared lamp.

23. The heat therapy apparatus of claim 19 further comprising a circuit board mounted to the base, wherein the heater is connected to the circuit board, and two of the plates and brushes are in electrical communication with the circuit board for conducting electricity from the housing to the circuit board.

24. The heat therapy apparatus of claim 19 wherein the pair of conductive plates are each mounted to the housing, and the pair of conductive brushes are each mounted to the base in electrical communication with the heater for conducting electricity from the plates to the heater.

25. The heat therapy apparatus of claim 24 wherein the plates are generally annular.

26. The heat therapy apparatus of claim 19 further comprising a massage formation provided on the base for providing a massage effect.

27. The heat therapy apparatus of claim 26 wherein the heater further comprises at least one infrared lamp disposed beneath the massage formation.

28. The heat therapy apparatus of claim 26 wherein the heater further comprises at least one infrared lamp disposed within the massage formation.

* * * * *

UNITED STATES PATENT AND TRADEMARK OFFICE

CERTIFICATE OF CORRECTION

PATENT NO. : 7,722,553 B2
APPLICATION NO. : 11/972071
DATED : May 25, 2010
INVENTOR(S) : Mordechai Lev et al.

It is certified that error appears in the above-identified patent and that said Letters Patent is hereby corrected as shown below:

Column 7, Line 50, Claim 11:

Delete "farther" and insert -- further --.

Signed and Sealed this

Seventeenth Day of August, 2010

David J. Kappos

David J. Kappos
*Director of the United States Patent and Trademark Office*